US005720433A

United States Patent [19]

Forker

[11] Patent Number: 5,720,433

[45] Date of Patent: Feb. 24, 1998

[54] DRAW BACK VALVE FOR A GLUE GUN

[75] Inventor: Joel C. Forker, Rye, N.H.

[73] Assignee: Dexter Corporation, Seabrook, N.H.

[21] Appl. No.: 593,857

[22] Filed: Jan. 30, 1996

[51] Int. Cl.[6] ..... B05B 15/02

[52] U.S. Cl. ..... 239/119; 239/571; 137/329.1; 137/496

[58] Field of Search ..... 239/119, 106, 239/104, 571, 570, 569, 583, 533.15; 137/329.1, 496, 541

[56] References Cited

U.S. PATENT DOCUMENTS

| | | | |
|---|---|---|---|
| 2,077,938 | 4/1937 | Kuttner | 239/119 X |
| 3,348,520 | 10/1967 | Lockwood | 239/119 X |

*Primary Examiner*—Lesley D. Morris
*Attorney, Agent, or Firm*—William B. Ritchie

[57] ABSTRACT

A draw back valve for fluid applicators for controlling the dripping or deposit of fluid at the nozzle orifice. The invention features a poppet within a stem which serves as a "piston". In the open position, the poppet is disposed within a chamber that has sufficient clearance to permit unrestricted fluid flow. Once it is desired to shut off fluid flow, the poppet slides in the reverse direction and is disposed within a cylinder bore such that the poppet now functions as a "piston" causing the flow to reverse. The reverse flow creates a partial vacuum at the valve "nozzle" thus causing the fluid that was being dispensed to be drawn back into the nozzle, thus, eliminating drips or dried fluid at the tip. The invention is particularly well suited for use in hand-held hot melt glue guns, however, has application to other fields as well such as paint spraying.

7 Claims, 4 Drawing Sheets

DRAW BACK VALVE FOR A GLUE GUN

BACKGROUND OF THE INVENTION

1. Field of the Invention

The invention relates generally to hot glue gun apparatus, more particularly, to valves directed to stopping the flow of glue.

2. Description of the Related Art

Glue guns and hot melt applicators are common in industry and are used to apply an adhesive to a work piece. The typical apparatus uses a solid stick of glue that is heated. In the simplest versions, designed for homeowners, the glue stick is pushed by the user into a feed chamber which melts the glue and keeps the melted glue from returning back towards the stick. The melted glue then exits a nozzle and is applied to the article that is to be glued. The article is fastened as soon as the glue rapidly cools. One significant advantage of this type of gluing method is the elimination of any waiting time for the glue bond to occur. Thus, the use of the hot glue guns is extremely important to assembly line work where waiting for a glue to set-up is unacceptable. As a consequence of wide spread industry acceptance, this technique has spawned many improvements to the guns, including the addition of compressed air so that the hot melted glue may be sprayed rather than spread on from the applicator tip. Glue sticks have also been developed to meet a wide range of applications. The glue sticks have industrial standards for tolerances in diameter such that any glue gun may be utilized.

Major components of a commercial glue gun are similar to the basic version described above. This type of gun includes a drive end, feed chamber, melt chamber and nozzle. The function of a drive end is to move a solid stick of glue through the feed chamber as glue is applied. A feed chamber serves to allow a cool and solid glue stick to enter a hot melting chamber while at the same time the feed chamber seals against the glue stick to prevent molten fluid from leaking backwards. The melt chamber is electrically heated to melt the solid glue stick. The molten glue then travels through a valve which is connected to a nozzle. The nozzle is where the liquid glue is extracted and applied to a work piece.

A major problem with present apparatus is the difficulty in stopping the flow of hot glue once it has been started. Prior art glue guns are well known for dripping glue even when the trigger has been released or, even more common, leaving a string of glue from the work piece to the nozzle tip. The string results from residual glue being pulled out of the nozzle tip as the glue gun is pulled away from the workpiece. The undesirable dripping or stringing of glue from the nozzle tip adversely affects the quality of workmanship, wastes glue, and is a common nuisance to a user of the glue gun.

Traditional nozzles use a spring to push a ball bearing back against a metal seat to prevent free forward flow of glue. As the unit wears, a rough seat or ball bearing can result in leakage of glue from the melt applicator. In order to change the seat or ball bearing in this type of apparatus, removal and disassembly of the valve is required. Once the entire valve assembly has been removed, the glue in the gun will then run free, making replacement an extremely messy proposition. Even when this type of valve works as intended, it still leaves a residual amount of glue at the tip which will form a string when the gun is moved away from the work piece.

There is not found in the prior art a glue gun that features a stop valve that prevents glue from leaking once the trigger is released and also prevents the string that results from residual glue being pulled out of the nozzle tip as the gun is pulled away, nor is there found a gun that permits the repair of this valve while the gun is hot and filled with melted glue. These and other needs are satisfied by the present invention.

SUMMARY OF THE INVENTION

It is an aspect of the invention to provide a draw back valve that will make a positive seal using a readily changeable O-ring that will completely stop the fluid flow in the closed position.

An additional aspect of the invention is to provide a draw back valve that will cause a reverse flow of the hot fluid after the trigger is released thus ensuring that a "string" will not occur between the gun and article that is being glued when the gun is pulled away.

Still another aspect of the invention is to provide a draw back valve that has an O-ring that can be easily replaced even while the blue gun is filled with hot blue.

Another aspect of the invention is to provide a draw back valve that is suitable for use in any situation where a fluid, under pressure, exits a nozzle.

It is still another aspect of the invention to provide a draw back valve that will draw any fluid remaining at the tip back inside when the apparatus is shut off, thereby, preventing the formation of a "string" when the gun is moved away from the work piece.

The invention is a valve for use with a fluid applicator apparatus that applies a fluid under pressure. A stem with an opening therethrough is provided. The stem has an inlet end, exit end, with a cylinder bore at the inlet end, and a draw counter bore immediately adjacent to the cylinder bore. The stem also has a seat at the exit end. A poppet is provided that has a piston-like end and a seat end. The poppet is slidably positioned within the opening of the stem. The pressure from the apparatus provides an open position in the valve with the piston-like end of the poppet disposed within the draw counter bore of the stem and with the seat end of the poppet disposed away from the seat of the stem, wherein the fluid enters the stem at the inlet end and flows through, exiting the exit end of the stem. The release of pressure from the apparatus provides a closed position with the piston-like end of the poppet first moving from within the draw counter bore of the stem into the cylinder bore of the stem with the seat end of the poppet moving toward the seat of the stem, wherein at least a portion of the fluid within the stem flows from the exit end of the stem towards the inlet end thereby creating a partial vacuum at the exit end of the stem, then the piston-like end of the poppet further moving within the cylinder bore of the stem with the seat end of the poppet seating against the seat of the stem, wherein the fluid flow stops.

These and other advantages and features, which characterize the invention, are set forth in the claims annexed hereto and forming a further part hereof. However, for a better understanding of the invention, and the advantages and objectives obtained by its use, reference should be made to the drawings, and to the accompanying descriptive matter, in which there is described a preferred embodiment of the invention.

DETAILED DESCRIPTION OF THE INVENTION

Figure 2:
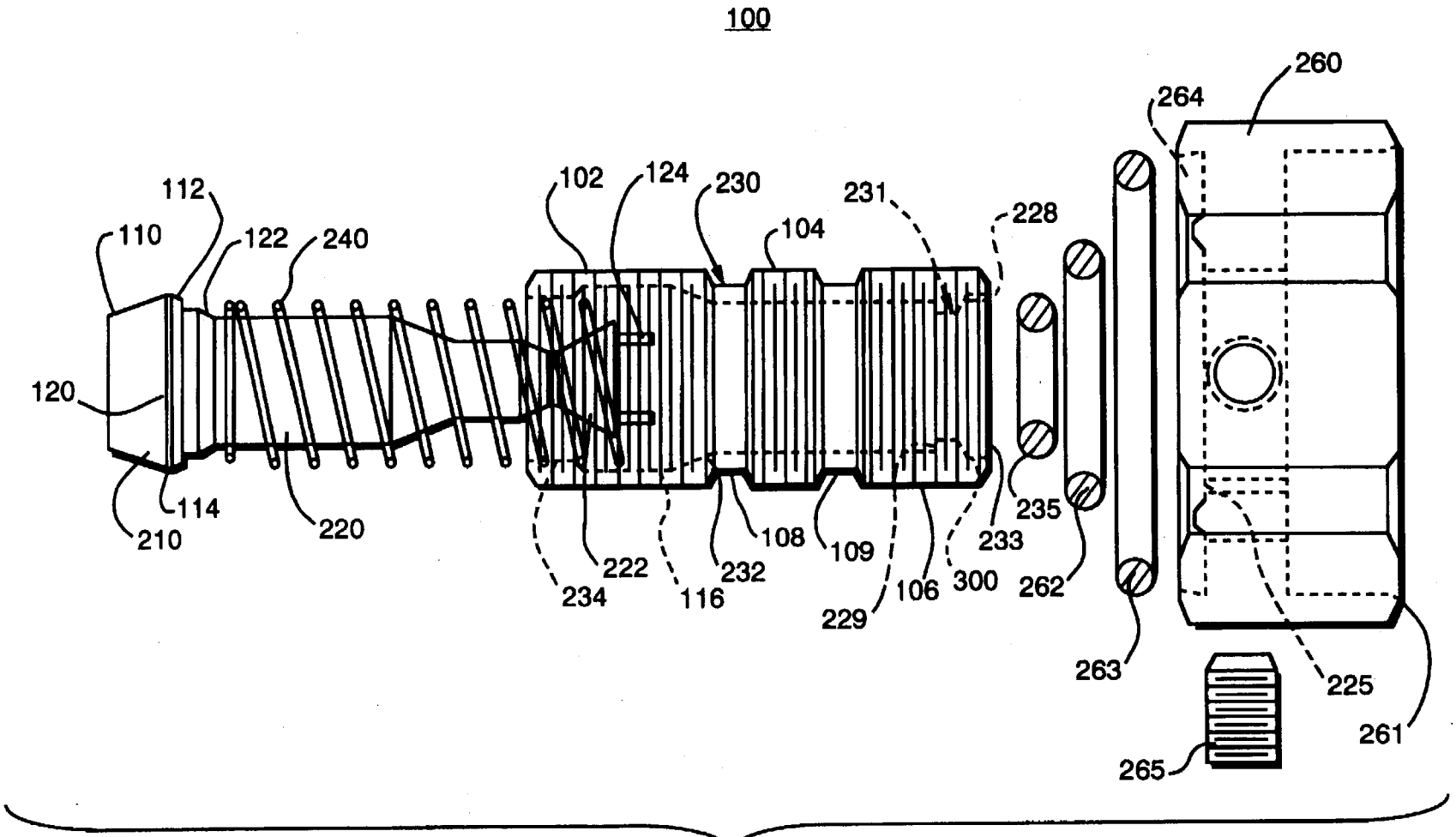
FIG. 2 is an exploded side view of the draw back valve in accordance with the invention.

Referring to the drawings, wherein like numerals represent like parts throughout the several views, there is generally disclosed draw back valve 100 consistent with the principles of the present invention, depicted in FIG. 2.

Although the invention is shown being used with hot melt glue gun 50, those skilled in the art will appreciate that this type of applicator is only one of many applications in which the principles of the present invention might be utilized. Those skilled in the art will appreciate that draw back valve 100 may be utilized in any application where it is desirable to prevent dripping and to draw back any fluid still remaining at the tip to the inside of the applicator. For example, when paint is sprayed, paint allowed to remain at the nozzle tip after use will harden. Use of the invention will draw the paint at the nozzle tip inside where it will remain free-flowing since it will be isolated from drying air. Accordingly, the draw back valve 100 herein should not be construed as being limited to use in a hot melt glue apparatus. Invention 100 is suitable for use in any apparatus that is designed to spray or apply a fluid under pressure.

Figure 1:
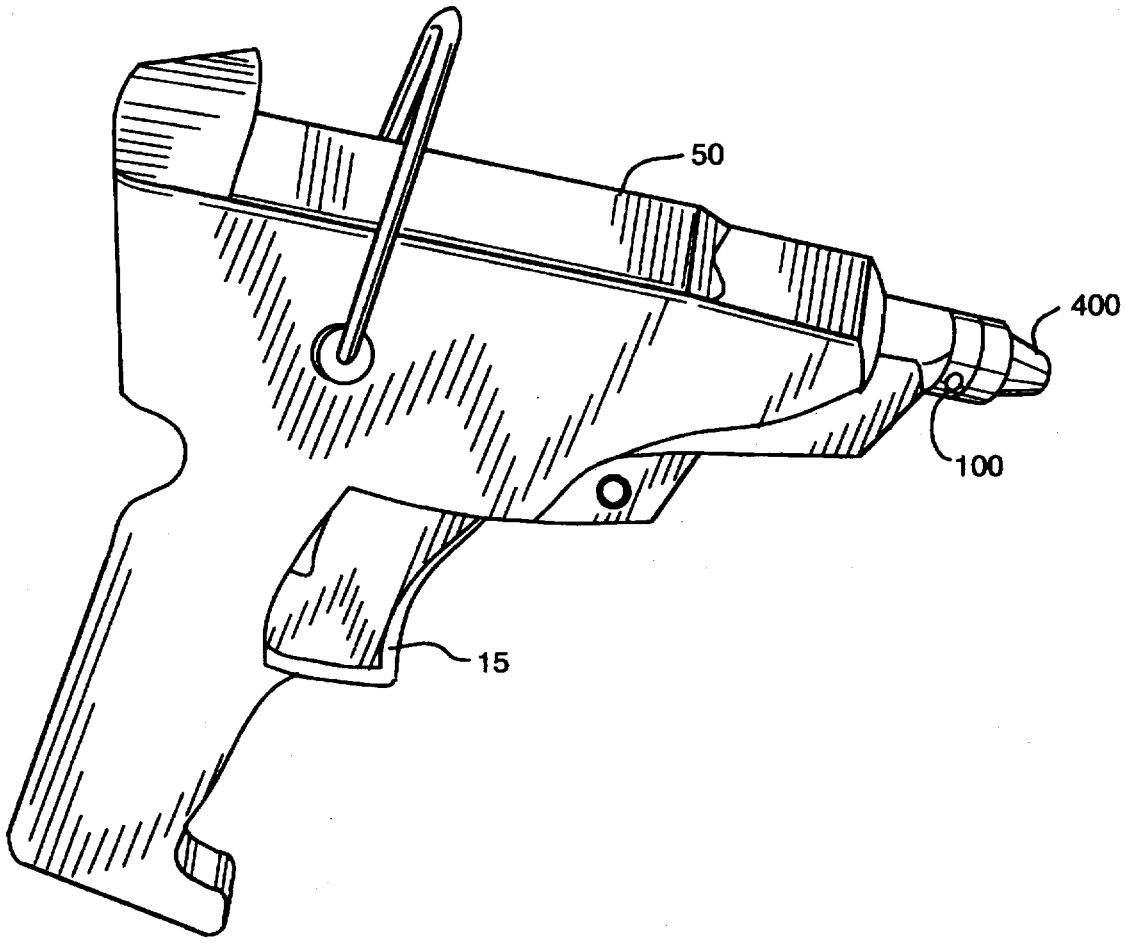
FIG. 1 is a cross-sectional side view of a typical hot melt applicator that utilizes the invention.

Referring to FIG. 1., a typical hot melt glue gun 50 is depicted such as manufactured by the Dexter Corporation of Seabrook, New Hampshire and sold as HYSOL 4210 hot melt applicator. This type of gun can be configured to apply glue either in a bead or sprayed on a workpiece.

Major components of glue gun 50 include a drive end, feed chamber, melt chamber and nozzle 400. The function of a drive end is to move a solid stick of glue through the feed chamber 300 as glue is applied. A feed chamber serves to allow a cool and solid glue stick to enter a hot melt chamber while at the same time the feed chamber seals against the glue stick to prevent molten fluid from leaking backwards. The melt chamber is electrically heated to melt the solid glue stick. The molten glue then travels through invention 100 which is connected between the melt chamber and nozzle 400. The nozzle 400 is where the liquid glue is applied to a work piece (not shown).

FIG. 2 is an exploded side view of invention 100 which enables the flow of glue to be shut-off upon release of the trigger 15 and to automatically draw the liquid glue at the tip back inside the unit. The major components of invention 100 include a stem 230, poppet 220 and an easily replaceable seal provided by valve O-ring 235. The draw back valve has an open position (FIGS. 3, 5 and 6), a closed position (FIG. 7), and an O-ring replacement position (FIG. 8). Valve spring 240 urges poppet 220 located within the stem 230 to seat tightly against O-ring 235 when valve 100 is in the closed position. As will be discussed below, other methods could be used instead of spring 240 to seat stem 230 to provide a "closed position". A mechanical or electromagnetic linkage between stem 230 and trigger 15 or associated assemblies could be used to urge stem 230 against its seat to provide a closed position instead of spring 240. However, for use in a glue gun, spring 240 is the preferred method due to its simplicity and low cost.

The stem 230 preferably has a cylindrical configuration. However, this cross-sectional shape is not critical and the invention could also be used with other cross-sectional shapes as well such as a square. Stem 230 can be machined from any metal or plastic material that is compatible with the liquid that is being applied. For example, using hot melt glue requires the use of a metal of constructing stem 230. However, if stem 230 is being used with paint, hard plastic such as nylon would be acceptable.

Stem 230 is threaded at regions 102, 104, and 106. Thread region 102 is used to fasten invention 100 to an applicator apparatus such as glue gun 50. Nut 260 is threaded on to region 104. Threaded region 106 is used to attach nozzle 400 (shown in FIG. 4). Recess region 108 is sized to accommodate O-ring 262, preferably a size #11 silicone O-ring. Recess region 109 does not require the use of an O-ring in the preferred embodiment but may be added as an option. Ridge 231 serves to anchor one end of spring 240 at shoulder 229. The "nozzle" side of ridge 231 serves, via shoulder 228 in conjunction with diameter 300, to provide a seat for O-ring 235. The valve seat is far forward on the valve to minimize the residual fluid downstream of the shut-off. Minimizing the residual volume is important due to temperature cycling in glue guns which can cause the volume to expand and push glue toward the discharge orifice 418. Also, O-ring 235's far forward position makes it readily accessible for easy replacement without the removal of the entire invention 100. Therefore, ridge 231 is positioned adjacent to stem exit 233 in accordance with the diameter of O-ring 235. Cylinder bore 234 is provided immediately adjacent to the inlet of stem 230. The diameter of cylinder bore 234 is selected as a function of the diameter of the tail section 210, the diameter of nozzle orifice, and the fluid being used. Draw counter bore 116 provides a path for fluid to flow around stem 230 when invention 100 is in the "open" position. Shoulder 232 at the "nozzle end" of draw counter bore 116 is dimensioned to have a diameter smaller than the diameter of tail section 210 which serves as a stop to prevent tail section 210 from being inserted too far into stem 230. Hot melted glue enters cylinder bore 234, passes through draw counter bore 116 and eventually exits exit 233.

Poppet 220 is sized and configured to be disposed within the stem 230. As with stem 230, the materials selected depend primarily on the fluid that is being applied. Interface 114 is the widest diameter of tail section 210 of poppet 220. This diameter is selected to correspond to the diameter of cylinder bore 234 of stem 230. That is, tail section 210 is designed to fit like a "piston" or a "plunger" within cylinder bore 234. The clearance 242 (shown in FIG. 3) between interface 114 and cylinder bore 234 is a function of the viscosity of the fluid being used in the apparatus. Highly viscous fluids such as melted glue allow a greater tolerance and still have the invention function properly. Therefore, interface 114, in the example described herein, is preferably a narrow flat that is machined onto tail section 210 between shoulder 112 and shoulder 110.

Fluids such as thinned paint would require a much closer tolerance and preferably use optional seal 120 which could be an O-ring 120 or a piston ring-type of seal that is well known in the art.

Shoulder 122 provides the other stop for spring 240. At the "nozzle end" of poppet 220, pins 124 are attached to head 222. Pins 124 serve as a stop against surface 214 in nozzle section 400 to prevent poppet 220 from moving too close to surface 214 in nozzle section 400, thereby shutting off flow.

Nut 260 is used to attach nozzle section 400. The nut 260 is internally threaded and is attached to the external threads of the stem 230 at region 104. A user should apply a suitable anaerobic thread sealant to the threads when installing the nut 260 onto the stem 230. The nut 260 has an internal bored section 261 that is sized and configured to accommodate nozzle section 400 such that a portion of nozzle body 411 is partially disposed within nut 260.

Figure 3:
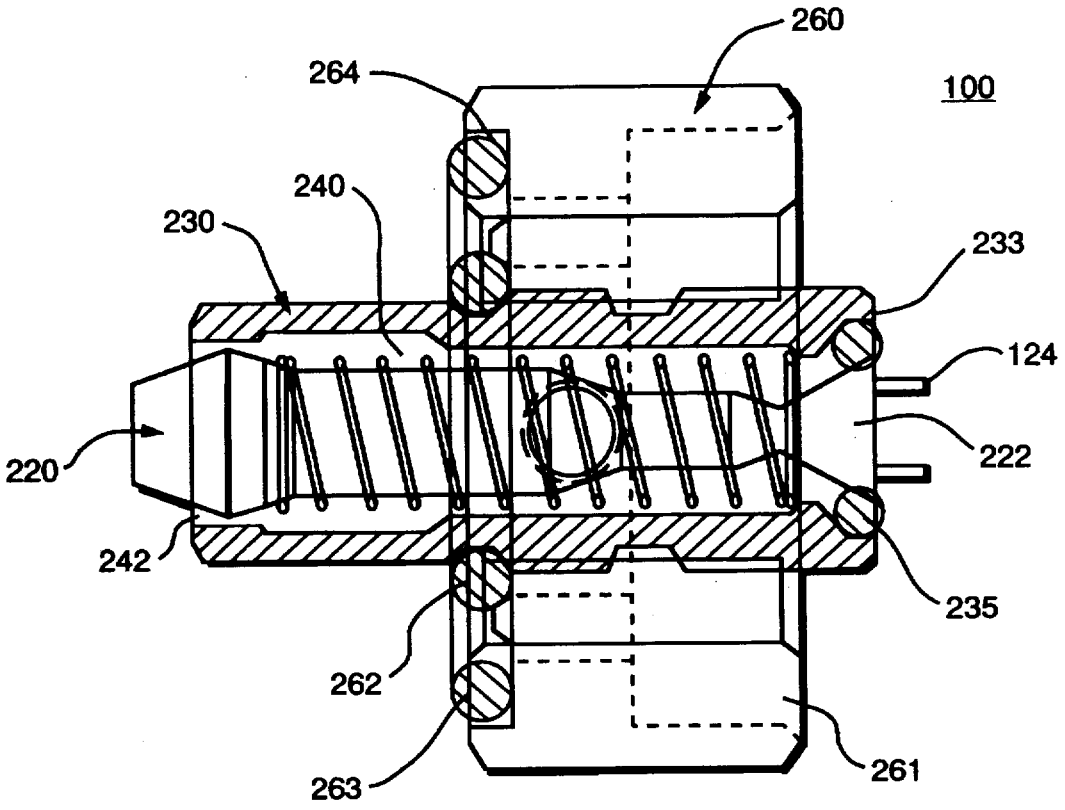
FIG. 3 is an assembled cross-sectional side view.

Recess 264 is dimensioned to hold O-ring 263 and recess 225 is dimensioned to hold O-ring 262. As shown in FIG. 3, once assembled, invention 100 is then threaded into glue gun 50. O-rings 262 and 263 prevent hot melted glue from leaking past invention 100. O-ring 263 is also preferably a size #17 silicone type of O-ring. Set screw 265 keeps nut 260 locked onto stem 230. The set screw is preferably 6–32 ×3/16" but may be other dimensions and still function properly.

Referring now to FIG. 3, invention 100 is shown assembled with nut 260 fastened to stem 230 and poppet 220 inserted into stem 230 depicting the "closed" position.

Figure 4:
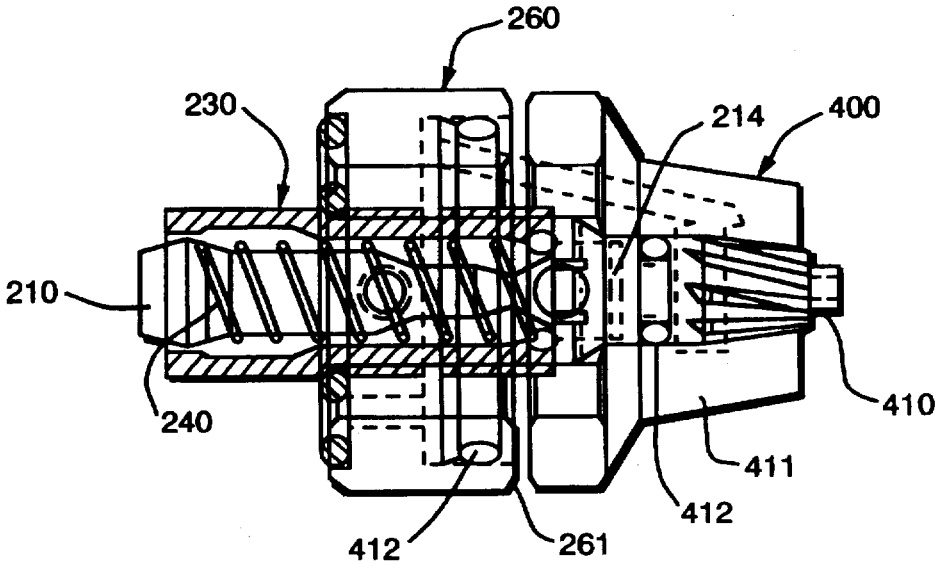
FIG. 4 is a cross-sectional side view assembled with a typical nozzle assembly.

Referring now to FIG. 4, invention 100 is shown attached to a typical nozzle section 400. Nozzle tip has orifice 418 through which glue is either sprayed or deposited, depending on the type of nozzle selected. O-ring 412 is disposed over the external circumference of the nozzle tip 410.

In the preferred embodiment, invention 100 and associated parts are sized to fit within the hand held melt applicator 50. The valve spring 240, nut 260, and nozzle assembly 400 are preferably manufactured from stainless steel. The stem 230 and poppet 220 are preferably manufactured from nickel-plated brass. However, as noted above, other materials would suffice and are considered to be consistent with the principles of the present invention. O-ring 235 is preferably manufactured from VITON, while the remaining seals are typically silicone.

Figure 5:
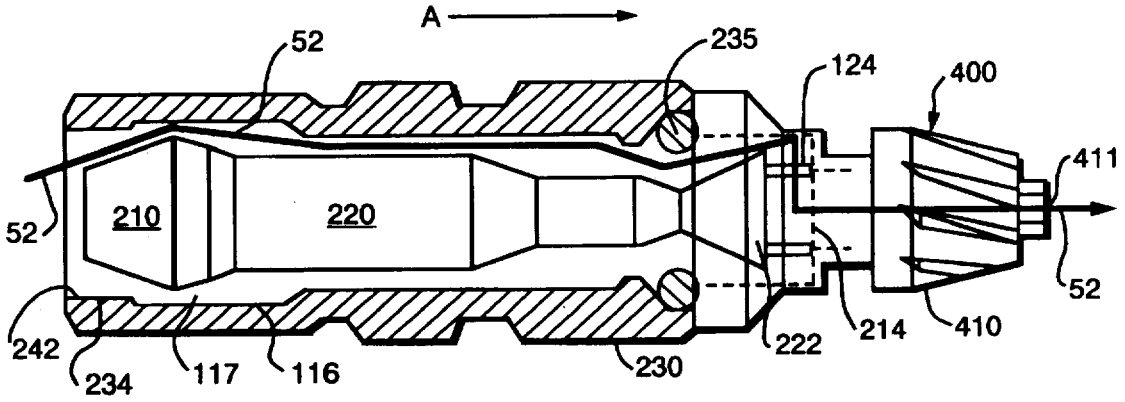
FIG. 5 is a cross-sectional side view showing the fluid flow with the valve in an open position with a typical nozzle.
Figure 6:
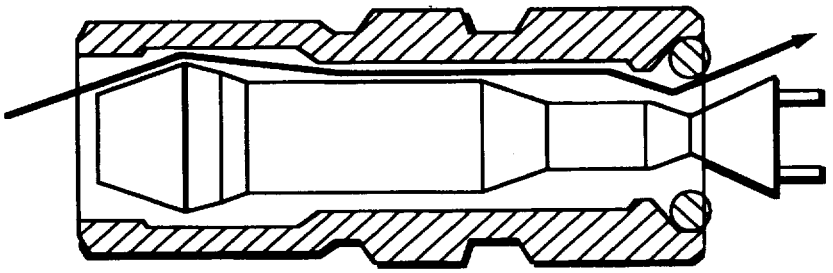
FIG. 6 is the cross-sectional side view of FIG. 5 shown without the nozzle.

Referring now to FIGS. 5–8, the operation of invention 100 will be explained. In FIGS. 5 and 6, the open flow condition is described. Once trigger 15 of gun 50 is actuated, melted glue 52 is placed under pressure, causing poppet 220 to slide within stem 230 in the direction of arrow A, that is, slide towards the "nozzle" end of invention 100. Tail 210 then slides from cylinder bore 234 into draw counter bore 116, thus the clearance between tail 210 and stem 230 increases from clearance 242 to clearance 117 which permits glue 52 to easily flow around poppet 220. Simultaneously, head 222 moves away from O-ring 235 which establishes an open pathway so that glue 52 is able to exit orifice 418. In FIG. 5, nozzle body 411 has been removed, leaving only nozzle tip 410 for the sake of clarity. Note that stem is prevented from moving too far towards nozzle tip 410 by pins 124 which are stopped by surface 214 of nozzle tip 410. Glue 52 is able to flow around pins 124 preventing the flow from being stopped. FIG. 6 shows the flow of glue 52 with nozzle tip 410 removed as well. This position will be maintained as long as a user keeps trigger 15 of gun 50 actuated.

Figure 7:
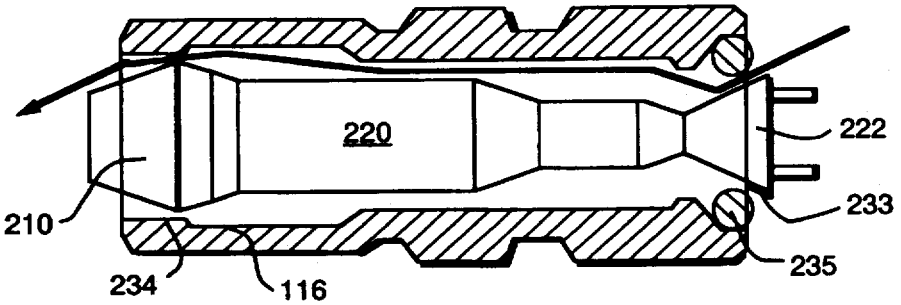
FIG. 7 is a cross-sectional side view of the valve in the closed position, without a nozzle.
Figure 8:
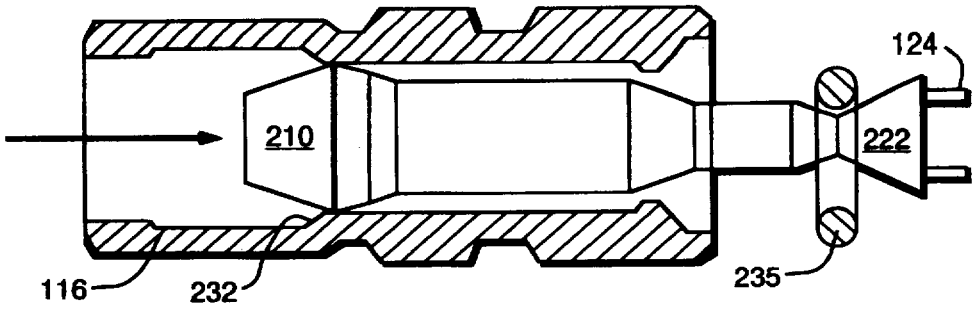
FIG. 8 is a cross-sectional side view of the valve in position to replace the valve O-ring.

Referring now to FIG. 7, the operation of invention 100 when trigger 15 is released will be explained. Upon release of trigger 15, pressure against tail section 210 of poppet 220 will immediately start to decrease. Once the force of spring 240 (not shown in this figure for the sake of clarity) exceeds the falling pressure against tail section 210, poppet 220 will begin to slide in direction B, thus tail section 210 will move from draw counter bore 116 to cylinder bore 234. Since tail section 210 fits snugly within cylinder bore 234, poppet 220 now functions as a "piston" causing the flow of glue 52 to reverse. Since the volume displaced by tail section 210 is substantially greater than the volume of the orifice 418 and the immediate channel within nozzle tip 410, melted glue 52 at orifice 418 will be drawn back toward tail section 210 by the partial vacuum created at stem exit 233. Thus, a small movement in poppet 220 will cause glue 52 to be drawn back well inside of nozzle tip 410, thus eliminating drips or "strings" in the case of glue, or drips or plugged orifices with dried paint when used with a paint sprayer. As head 222 seats against O-ring 235, all flow stops and glue 52 remains contained entirely within gun 50.

As discussed above, spring 240 is only one of several different methods that can be used to reverse the direction of movement of poppet 220 once the pressure of glue 52 against poppet 220 begins to decrease. However, the use of spring 240 is one of the simplest and is preferred for the typical hand-held hot melt glue gun application.

Referring now to FIG. 8, the operation of changing O-ring 235 will be discussed. If glue gun 50 starts to drip after the trigger 15 has been released, this indicates that it is probably time to change O-ring 235 due to wear. O-ring 235 can be easily changed without dismantling the entire gun 50, even when the gun 50 is hot and filled with melted glue 52. Nozzle 400 is first removed. The back face of nozzle 400 is in contact with the exit end 233 of stem 230. This serves to hold O-ring 235 in its seated position during normal operation. When nozzle 400 is removed, then O-ring ring 235 can be removed. Trigger 15 is pressed with the gun 50 pointed in a safe direction since a small amount of glue 52 will be discharged. As shown in FIGS. 5 and 6, the pressure of the melted glue 52 against poppet 210 causes poppet 210 to slide within stem 230 as before. However, with nozzle 400 not in place, pins 124 are no longer stopped by surface 214. Therefore, head 222 is free to travel further within stem 230 until tail section 210 encounters shoulder 232 located at the "nozzle" end of draw counter bore 116. With the trigger still pressed, pressure keeps poppet 220 urged against shoulder 232 which stops the flow of glue 52. Then, O-ring 235 is popped free of shoulder 228 and its seat and slides over poppet 220 and off head 222. A new O-ring 235 is first slipped over head 222, then head 222, with O-ring 235 attached, is reinserted so that O-ring 235 is re-seated. Once O-ring 235 is properly seated, the trigger 15 can be released, the poppet head retracts to retain the O-ring in place, and the maintenance operation is completed.

In some applications, the use of O-ring 235 may be unnecessary. The liquid material may be inherently lubricating and non-caustic where the life expectancy of the "valve" and its seat is sufficiently long such that the added expense of providing for the O-ring sealing method is unnecessary. Under such circumstances, a properly shaped head 222 and a corresponding valve seat at the "nozzle" end of stem 230 would be all that is required.

While there have been described what are at present considered to be the preferred embodiment of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A valve for use with a fluid applicator apparatus that applies a fluid under pressure comprising:

a stem with an opening therethrough, said stem having an inlet end, exit end, with a cylinder bore at the inlet end, a draw counter bore immediately adjacent to said cylinder bore, and said stem having a seat at said exit end;

a poppet having a piston-like end and a seat end, wherein said poppet is slidably positioned within the opening of said stem;

such that pressure from said apparatus provides an open position in said valve with said piston-like end of said poppet disposed within said draw counter bore of said stem and with said seat end of said poppet disposed away from said seat of said stem, wherein the fluid enters said stem at said inlet end and flows through, exiting said exit end of said stem, and such that release of pressure from said apparatus provides a closed position with said piston-like end of said poppet first moving from within said draw counter bore of said stem into said cylinder bore of said stem with said seat end of said poppet moving toward said seat of said stem, wherein at least a portion of the fluid within said stem flows from the exit end of said stem towards said inlet end thereby creating a partial vacuum at the exit end of said stem, then said piston-like end of said poppet further moving within said cylinder bore of said stem with said seat end of said poppet seating against said seat of said stem, wherein the fluid flow stops.

2. The valve of claim 1 wherein said seat of said stem further comprises an O-ring seal.

3. The valve of claim 2 further comprising a spring surrounding said poppet, disposed between said piston-like end of said poppet and said exit end of said stem, wherein pressure from said apparatus causes said spring to compress thus achieving the open position, and wherein release of pressure from said apparatus causes said spring to decompress resulting in the closed position with said seat end of said poppet finally firmly urged against said seat of said stem.

4. The valve of claim 3 wherein said poppet further comprises at least one pin at said exit end of said poppet such that said pin engages a surface stop when said poppet slidably moves in the open position thereby limiting movement of said poppet to ensure that the fluid flow is not restricted.

5. The valve of claim 4 wherein said draw counter bore further comprises a shoulder having a diameter smaller than said piston-like end of said stem, wherein slidable movement of said poppet toward said exit end of said stem when pressure from said apparatus is applied thereto in the absence of the surface stop, is limited to ensure that said poppet does not exit said stem when said O-ring is to be replaced.

6. The valve of claim 1 wherein said fluid applicator is a glue gun having a nozzle with a tip and said fluid is hot melted glue such that the partial vacuum created at the exit end of said stem during the closed position causes the hot melted glue at the nozzle tip to be drawn back inside the nozzle.

7. The valve of claim 1 wherein said fluid applicator is a paint sprayer having a nozzle with a tip and said fluid is paint such that the partial vacuum created at the exit end of said stem during the closed position causes the paint at the nozzle tip to be drawn back inside the nozzle.

* * * * *